US006152779A

United States Patent [19]

Madsen et al.

[11] Patent Number: 6,152,779

[45] Date of Patent: Nov. 28, 2000

[54] CONNECTOR SHIELD

[75] Inventors: Brent Madsen, Providence; David Oliphant, West Valley City; Thomas A. Johnson, Draper; Ryan A. Kunz, Roy, all of Utah

[73] Assignee: 3Com Corporation, Santa Clara, Calif.

[21] Appl. No.: 09/201,322

[22] Filed: Nov. 30, 1998

[51] Int. Cl.[7] ..... H01R 23/02

[52] U.S. Cl. ..... 439/676; 439/946

[58] Field of Search ..... 439/676, 94.6, 439/131, 586, 135, 136

[56] References Cited

U.S. PATENT DOCUMENTS 5,411,405 5/1995 McDaniels et al. ..... 439/676

*Primary Examiner*—Kheim Nguyen

*Assistant Examiner*—Son Nguyen

*Attorney, Agent, or Firm*—Workman, Nydegger & Seeley

[57] ABSTRACT

The present invention is a shield which protects the electrical connections between a media interface and a physical/electrical media connector. The shield is made of a material which meets the electrical and safety specifications found in the IEEE 950 standard and the UL 1950 standard When a media connector is inserted in a media interface used in Type I and Type II PCMCIA cards, the shield covers and isolates the electrical connections between the media interface and the media connector and prevents current from flowing to an external object.

23 Claims, 1 Drawing Sheet

CONNECTOR SHIELD

BACKGROUND OF THE INVENTION

1. The Field of the Invention

The present invention relates to the field of computers. More particularly, it relates to an interface between a connector and a communications card and specifically to a physical/electrical media connector interface for use with a communications card such as a Type I or a Type II PCMCIA-architecture communications card, as typically used in laptop and notebook computers.

2. The Prior State of the Art

With the advent of laptop and notebook computers, the development of smaller computer cards were required. In response to these developments, standards of architecture such as the Personal Computer Memory Card International Association (PCMCIA) standard, which specifies both hardware and system software requirements, were developed. The PCMCIA standard specifies three types of cards. Type I PCMCIA cards are 3.3 millimeters thick. Type II PCMCIA cards are 5 millimeters thick and Type III PCMCIA cards are 10.5 millimeters thick. Typically, Type I cards are used for memory while Type II and Type III cards are used for modems, network cards or other input/output devices.

Inherent in input/output cards is an ability to communicate with an external system or device. For example, a modem must be able to connect to a phone system which means that a PCMCIA modem card must be able to connect to an RJ series media connector which is described in FCC Rule 68.500, subpart F. According to these specifications, RJ-series media connectors are more than 5 millimeters thick.

The thickness of RJ-series media connector presents a problem with regard to Type I and Type II PCMCIA cards because these two types of cards are 3.3 and 5 millimeters thick respectively. In order for PCMCIA cards to more easily connect to RJ-series media connectors, a retractable media interface was developed. Today, PCMCIA cards have a media interface capable of connecting to physical/electrical media connectors. This media interface is less than 5 millimeters thick and can be extended from and retracted into PCMCIA cards. When extended, RJ series media connectors may be inserted to the media interface and thereby connected to the PCMCIA modem card.

The retractable/extendible media interfaces used in a Type I or Type II PCMCIA cards do not always effectively isolate the electrical connections from the user. In fact, situations may develop where it is possible to touch the electrical contacts of the media connector when inserting or removing the media connector from the interface. Voltages in excess of 70 volts may be present on the contacts of media connectors. A short across these contacts could cause harm to either the user, the computer or the communications card.

SUMMARY AND OBJECTS OF THE INVENTION

The present invention isolates the electrical connections between a physical/electrical media connector, such as an RJ series media connector, and a media interface for a small form factor communications card such as a PC-card or a Type I or Type II PCMCIA card. When a media connector is inserted into a media interface, the electrical connections are not covered or insulated and it is possible to create a short across the contacts, causing harm to the user and/or the device. In order to prevent the harm or injury that may result from these electrical connections, an apparatus is provided which effectively covers and isolates the electrical connections formed when a media connector is inserted into a media interface. This apparatus can be made of any material having the requisite characteristics, which are defined in the IEEE 950 standard and the UL 1950 standard.

It is therefore an object of the present invention to cover and isolate the electrical connections between a media connector and a media interface.

It is yet another object of the present invention to prevent the electrical connections between the media connector and the media interface from being inadvertently touched by a user.

Additional objects and advantages of the invention will be set forth in the description which follows, and in part will be obvious from the description, or may be learned by the practice of the invention. The objects and advantages of the invention may be realized and obtained by means of the instruments and combinations particularly pointed out in the appended Claims. These and other objects and features of the present invention will become more fully apparent from the following description and appended Claims, or may be learned by the practice of the invention as set forth hereinafter.

BRIEF DESCRIPTION OF THE DRAWINGS

In order that the manner in which the above-recited and other advantages and objects of the invention are obtained, a more particular description of the invention briefly described above will be rendered by reference to specific embodiments thereof which are illustrated in the appended drawings. Understanding that these drawings depict only typical embodiments of the invention and are not therefore to be considered limiting of its scope, the invention will be described and explained with additional specificity and detail through the use of the accompanying drawings in which.

DETAILED DESCRIPTION OF THE PREFERRED EMBODIMENTS

Figure 1:
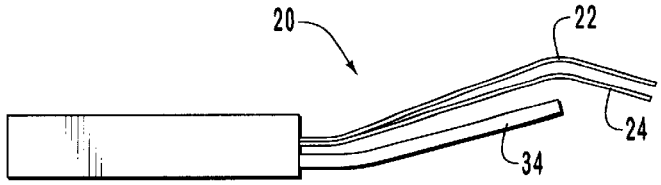
FIG. 1 is a perspective view of a shield.

The present invention is a shield which covers and isolates the electrical connection between a media interface and a physical/electrical media connector. FIG. 1 is a perspective view of a shield 20. Shield 20 has a first layer 22 and a second layer 24. First layer 22 is permanently bonded to second layer 24. First layer 22 and second layer 24 are preferably made of mylar, but may be made of any suitable material such as polyester film, polycarbonate film, polyetherimide, and the like. A suitable material satisfies the electrical and safety specifications as set forth in the IEEE 950 and UL 1950 standards. First layer 22 and second layer 24 can be made of the same material, or they can be made of different materials. Shield 20, as illustrated in FIG. 1, has two layers, but other embodiments of shield 20 contemplate more or less layers.

Figure 2:
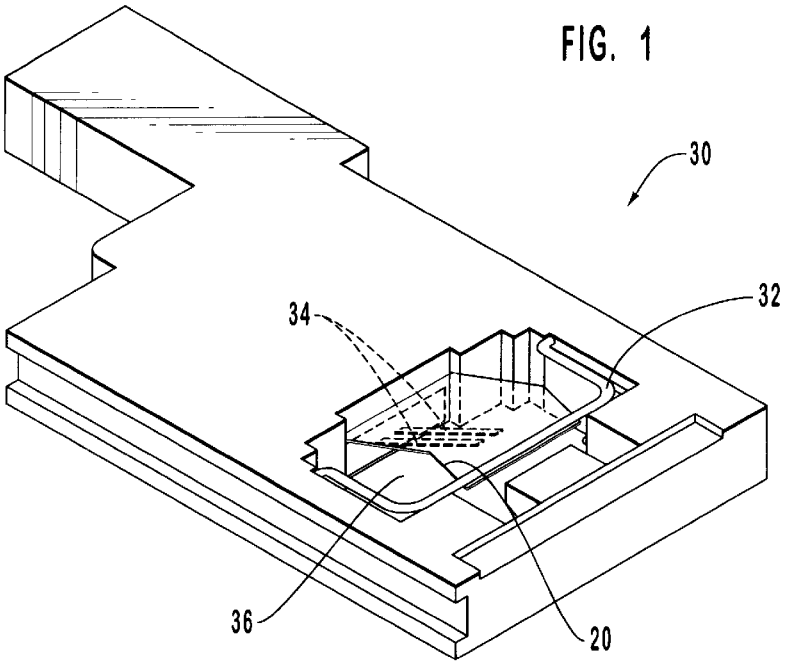
FIG. 2 is a perspective view of a shield attached to a media interface.

FIG. 2 is a perspective view of shield 20 connected to a media interface 30. Media interface 30 is retractable when used in Type I, Type II and Type III PCMCIA computer cards. Media interface 30, as illustrated, comprises a stirrup 32, a plurality of prongs 34, an aperture 36 and shield 20. Aperture 36 is sized and shaped to matingly receive a physical/electrical media connector, which includes but is not limited to RJ series media connectors. Stirrup 32 is rotatably mounted to media interface 30. Stirrup 32 correctly positions a media connector 50, shown in FIG. 3, in aperture 36 and prevents media connector 50 from passing through aperture 36. It is appreciated that many other embodiments of media interface 30 exist. U.S. Pat. Nos. 5,183,404, 5,338,210, and 5,547,401 are all illustrative of other embodiments of media interface 30 and are incorporated by reference.

Figure 3:
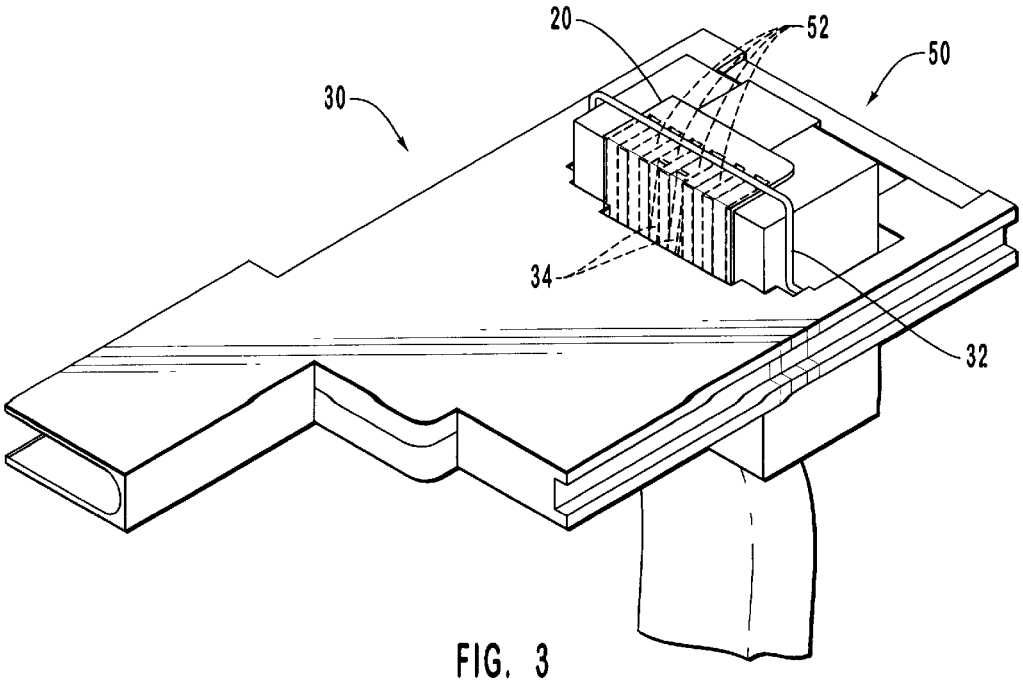
FIG. 3 is a perspective view of the shield covering the electrical connections between a media interface attached to a physical/electrical media connector.

FIG. 3 is a perspective view of media connector 50 matingly and detachably connected with media interface 30. Media connector 50 has a plurality of contacts 52 shaped and positioned to come into contact with prongs 34 when media connector 50 is matingly inserted into media interface 30. Prongs 34 extend into aperture 36 and when media connector is inserted in aperture 36, contacts 52 come into physical and electrical communication with prongs 34. When media connector 50 is completely inserted in media interface 30, prongs 34 are biased against contacts 52 with sufficient force to create reliable electrical connections. In other words, prongs 34 and contacts 52 as illustrated in FIG. 3, are in physical and electrical communication and form electrical connections.

As shown in FIG. 2, shield 20 is connected to media interface 30 below prongs 34. Shield 20 extends into aperture 36 further than prongs 34, which enables shield 20 to cover prongs 34 completely when media interface 30 is connected to a media connector. Shield 20 is sized and shaped to extend beyond prongs 34 and is configured to be wider than all prongs 34. The dimensions of shield 20 can change depending on the number of prongs. A media connector with two prongs may have a more narrow shield than a media connector with six prongs. The dimensions of shield 20 are such that shield 20 is capable of completely covering the electrical connections between prongs 34 and contacts 52, as illustrated in FIG. 3. Shield 20 protects the electrical connections from being shorted due to the touch of a user or another similar event that could create a short between the prongs.

Shield 20 is flexible and when media connector 50 is inserted in media interface 30, shield 20 adapts and conforms to the shape of media connector 50 as shown in FIG. 3. Stirrup 32 securely holds shield 20 in place against the surface of media connector 50 and thereby isolates the electrical connections. When media connector 50 is grasped by a user to remove it or insert it in media interface 30, shield 20 prevents the user from shorting the electrical connections with a finger. In effect, shield 20 prevents the flow of current from prongs 34, contacts 52 and the electrical connections between prongs 34 and contacts 52 to an object such as a user. The possibility creating a short or of receiving a shock from the electrical connections is eliminated by shield 20 as it covers and effectively insulates and isolates the electrical connections between prongs 34 and contacts 52.

When media connector 50 is inserted in media interface 30, shield 20 is moved downwards as are prongs 34. Stirrup 34 catches the end of shield 20 and bends the end toward media connector 50. When media connector 50 is fully inserted in media interface 20, stirrup 32 is holding the end of shield 20 against media connector 50 such that shield 20 cuts off external access to the electrical connections between prongs 34 and contacts 52. Thus, shield 20 eliminates the possibility of creating a short across the plurality of electrical connections. It is appreciated that shield 20 is capable of being configured to isolate and effectively insulate the electrical connections between similar media interfaces and media connectors. Shield 20 may also be constructed using a one layer material which is coated or one layer alone which satisfies the insulation requirements to prevent electrical contact with a user.

The present invention may be embodied in other specific forms without departing from its spirit or essential characteristics. The described embodiments are to be considered in all respects only as illustrative and not restrictive. The scope of the invention is, therefore, indicated by the appended Claims rather than by the foregoing description. All changes which come within the meaning and range of equivalency of the Claims are to be embraced within their scope.

What is claimed and desired to be secured by United States Letters Patent is:

1. A media interface for connecting a physical/electrical media connector to an electronic device, the media interface comprising:

an aperture formed in a retractable member;

one or more prongs attached to said retractable member and flexibly extending into said aperture, said aperture being shaped to receive the media connector to establish electrical contact between one or more contacts of the media connector and the one or more prongs flexibly extending into the aperture; and a shield connected to said retractable member, said shield having a first end connected to said retractable member and a second end being freely disposed within said aperture so that said shield is pivoted with said prongs upon insertion of said connector into said aperture, thereby allowing said connector to pass into and partially through said aperture, said shield having a length greater than a length of said one or more prongs, and said shield having a length less than a length of said aperture.

2. A media interface as recited in claim 1, wherein the shield is shaped and sized to cover an electrical connection between the one or more contacts and the one or more prongs.

3. A media interface as recited in claim 1, wherein the shield comprises a single layer.

4. A media interface as recited in claim 1, wherein the shield comprises two layers, and at least one of the layers is made of a material capable of insulating an electrical connection between the one or more contacts and the one or more prongs.

5. A media interface as recited in claim 4, wherein at least one of the layers is mylar.

6. A media interface as recited in claim 1, further comprising a stirrup pivotably attached to said retractable member, said stirrup being sized and configured to limit the insertion of the media connector into the aperture, wherein the stirrup is configured to securely hold said shield proximate said one or more prongs.

7. A media interface as recited in claim 6, wherein the second end of the shield is positioned between the stirrup and an end of the media connector.

8. A system comprising:

a media connector including a plurality of contacts;

a media interface configured to be detachably connected to the media connector;

an aperture formed in the media interface and being sized and configured to receive the media connector, the aperture having a length and a width;

a plurality of prongs including a first end connected to said media interface and a second end extending into the aperture, wherein the contacts come into electrical and physical communication with the prongs and form an electrical connection when the media interface is detachably connected to the media connector; and a shield including a first end, a second end, a length and a width, the first end of the shield being attached to the media interface proximate the first end of the plurality of prongs, the second end of the shield being freely disposed in the aperture when the media connector is not connected to the media interface, the length of the shield being generally equal to or greater than the length of the plurality of prongs, the length of the shield being generally less than the length of the aperture and the width of the shield being generally less than the width of the aperture.

9. A system as in claim 8, wherein the shield includes a first layer that is permanently bonded to a second layer.

10. A system as in claim 9, wherein the first layer and the second layer are constructed of an electrically insulating material.

11. A system as in claim 9, wherein the first layer or the second layer are constructed of an electrically insulating material.

12. A media interface comprising:

a body including an aperture configured to be detachably connected to a media connector;

a plurality of prongs extending into the aperture; and a shield securely connected to the body and extending into the aperture, the shield including a first end, a second end, a length and a width, the first end of the shield being attached to the body proximate the plurality of prongs, the second end of the shield freely extending into the aperture, the length of the shield being generally equal to or greater than the length of the plurality of prongs, the length of the shield being generally less than a length of the aperture and the width of the shield being generally less than a width of the aperture, the shield being capable of shielding an electrical connection.

13. A media interface as in claim 12, wherein the shield further comprises a first layer and a second layer, wherein the first layer is permanently bonded to the second layer.

14. A media interface as in claim 13, wherein the first layer and the second layer are made of a material capable of insulating an electrical connection.

15. A media interface as in claim 14, wherein the material is mylar.

16. A media interface as in claim 13, wherein at least one of the layers is constructed from a polyester film.

17. A media interface as in claim 13, wherein at least one of the layers is constructed from a polycarbonate film.

18. A media interface as in claim 13, wherein at least one of the layers is constructed from a polyetherimide film.

19. A media interface for connecting a media connector to an electronic device, the media interface comprising:

a retractable member;

an aperture formed in the retractable member, said aperture having a length and a width, said aperture being sized and configured to receive the media connector;

one or more prongs including a first end, a second end and a length, said first end being attached to said retractable member and said second end freely extending into said aperture, said one or more prongs being sized and configured to allow electrical communication to be established between said one or more prongs and one or more corresponding contacts on the media connector; and a shield including a first end, a second end, a length and a width, said first end of the shield being attached to said retractable member proximate said one or more prongs, said second end of said shield freely extending into said aperture, said length of said shield being generally equal to or greater than said length of said one or more prongs, said length of said shield being generally less than the length of said aperture and said width of said shield being generally less than the width of said aperture.

20. The media interface as in claim 19, wherein the shield covers a first portion of the media connector including the electrical connection between the one or more contacts and the one or more prongs, and wherein the shield does not cover a second portion of the media connector such that said second portion of the media connector is freely exposed.

21. The media interface as in claim 19, wherein the shield includes two layers and at least one of the layers is constructed of a material capable of insulating the electrical connection between the one or more contacts and the one or more prongs.

22. The media interface as in claim 19, further comprising a stirrup pivotably attached to said retractable member, said stirrup being sized and configured to limit the insertion of the media connector into the aperture, wherein the stirrup is configured to securely hold said shield proximate said one or more prongs.

23. The media interface as in claim 22, wherein the second end of the shield is positioned between the stirrup and an end of the media connector.

* * * * *

UNITED STATES PATENT AND TRADEMARK OFFICE

CERTIFICATE OF CORRECTION

PATENT NO. : 6,152,779
DATED : November 28, 2000
INVENTOR(S) : Brent Madsen, David Oliphant, Thomas A. Johnson and Ryan A. Kunz It is certified that error appears in the above-identified patent and that said Letters Patent is hereby corrected as shown below:

Title page,
Item [75] Inventors, after "Ryan A. Kunz, Roy" insert -- ; Steven Lo Forte, Midvale --

Signed and Sealed this

Twenty-eighth Day of May, 2002

*Attest:*

*Attesting Officer*

JAMES E. ROGAN
*Director of the United States Patent and Trademark Office*